US007070454B1

(12) United States Patent
Pepe et al.

(10) Patent No.: US 7,070,454 B1
(45) Date of Patent: Jul. 4, 2006

(54) ELECTRICAL CONNECTOR ADAPTOR WITH STRAIN RELIEF

(75) Inventors: Paul John Pepe, Clemmons, NC (US); Danny Gray Dollyhigh, Mount Airy, NC (US); Tony E. Beam, Belews Creek, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/244,985

(22) Filed: Oct. 6, 2005

(51) Int. Cl.
*H01R 25/00* (2006.01)

(52) U.S. Cl. ..... 439/638; 439/464; 439/470; 439/719

(58) Field of Classification Search ..... 439/464, 439/470, 638, 719
See application file for complete search history.

(56) References Cited

U.S. PATENT DOCUMENTS

| | | | | |
|---|---|---|---|---|
| 6,422,884 | B1 * | 7/2002 | Babasick et al. | 439/470 |
| 6,679,722 | B1 * | 1/2004 | Pulizzi | 439/451 |
| 6,948,949 | B1 * | 9/2005 | Schwartz et al. | 439/638 |
| 2005/0130488 | A1 * | 6/2005 | Zhu et al. | 439/470 |

* cited by examiner

*Primary Examiner*—Tho D. Ta

(57) ABSTRACT

An electrical connector adaptor for use with cable assemblies has been provided. The adapter comprises first and second contact sets and a housing. The housing has a first mating face configured to join with a mating connector and a second mating face configured to join with a cable assembly. The first and second mating faces retain the first and second contact sets in different first and second patterns, respectively. A strain relief is formed extending from the housing. The strain relief projects beyond the second mating face and is positioned such that the cable assembly rests against the strain relief when the cable assembly is joined to the second mating face. Optionally, a securing member is configured to secure the cable assembly to the strain relief.

20 Claims, 11 Drawing Sheets

ELECTRICAL CONNECTOR ADAPTOR WITH STRAIN RELIEF

BACKGROUND OF THE INVENTION

This invention relates generally to electrical connectors, and more particularly, to electrical connector adaptors that utilize strain relief.

Electrical connectors are used within many systems, such as personal computers, industrial systems, networks and the like. There are many different contact pin patterns, wire arrangements, interface formats and connector types available. Sometimes it is necessary to use an electrical connector adaptor as an interface between two or more different types of connectors. One problem encountered when using an electrical connector adaptor is that the connector or connectors may become disconnected from the adaptor. Therefore, the signals, data, and/or power being supplied or transferred is interrupted, causing data corruption and loss of data and/or productivity, for example, until the interconnection problem is located and resolved. Also, the wire and pin connections formed between the cable and the connector may be fragile. Therefore, if the cable experiences a lot of movement, the wires and pins may break or separate, causing a complete or intermittent loss of continuity.

Therefore, a need exists for an electrical connector adapter that prevents the connectors from becoming disconnected from the adaptor, and that also provides a measure of protection to the connector and cable assembly. Certain embodiments of the present invention are intended to meet these needs and other objectives that will become apparent from the description and drawings set forth below.

BRIEF DESCRIPTION OF THE INVENTION

In one embodiment, an electrical connector adaptor comprises first and second contact sets and a housing. The housing has a first mating face configured to join with a mating connector and a second mating face configured to join with a cable assembly. The first and second mating faces retain the first and second contact sets in different first and second patterns, respectively. A strain relief is formed extending from the housing. The strain relief projects beyond the second mating face and is positioned such that the cable assembly rests against the strain relief when the cable assembly is joined to the second mating face.

In another embodiment, an adaptor and cable assembly comprise at least one cable assembly with connectors provided on opposite ends thereof and an adapter. The adaptor comprises first and second contact sets and a housing having a first mating face configured to join with a mating connector. The housing has a second mating face configured to join with the cable assembly. The first and second mating faces retain the first and second contact sets in different first and second patterns, respectively. A strain relief extends from the housing, projecting beyond the second mating face. The cable assembly rests against the strain relief when joined to the second mating face, and is secured with a securing member to the strain relief.

DETAILED DESCRIPTION OF THE INVENTION

The foregoing summary, as well as the following detailed description of certain embodiments of the present invention, will be better understood when read in conjunction with the appended drawings. It should be understood that the present invention is not limited to the arrangements and instrumentality shown in the attached drawings.

Figure 1:
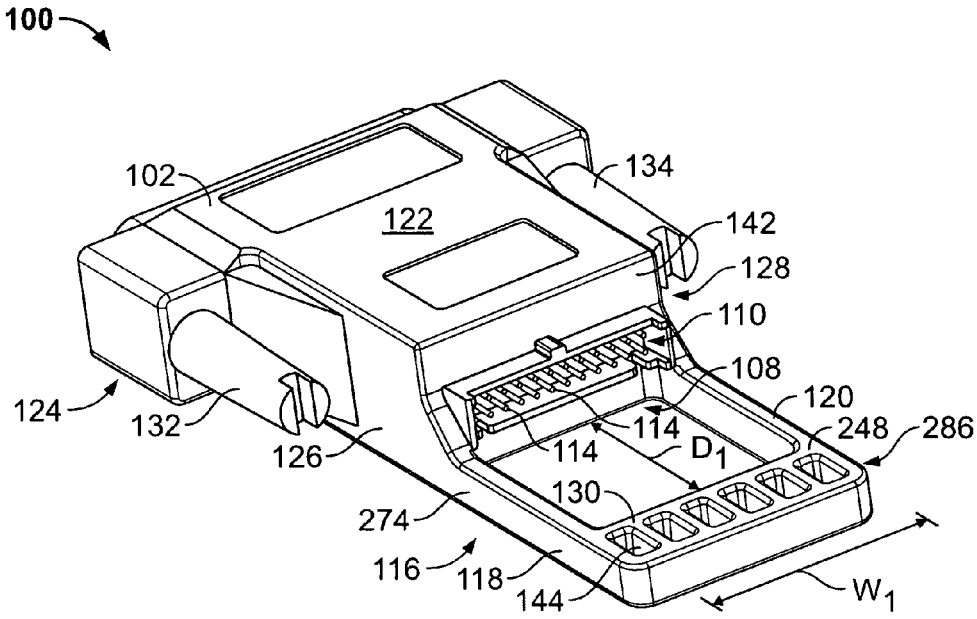
FIG. 1 illustrates a rear perspective view of an electrical connector adaptor in accordance with an embodiment of the present invention.
Figure 2:
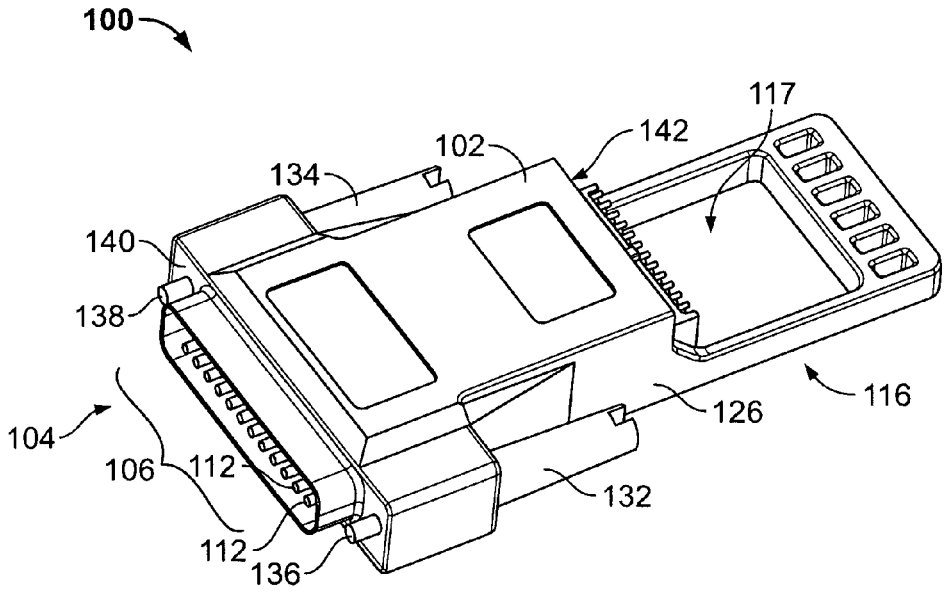
FIG. 2 illustrates a perspective view of an electrical connector adaptor in accordance with an embodiment of the present invention.

FIGS. 1 and 2 illustrate perspective views of an electrical connector adaptor 100 in accordance with an embodiment of the present invention. The adaptor 100 provides an interface between two different connector interfaces or connector and/or cable configurations. The adaptor 100 has a housing 102 with a top surface 122 formed opposite a bottom surface 124, and a first sidewall 126 formed opposite a second sidewall 128. The housing 102 includes a front end 140 having a first mating face 104 with a set of contacts 106 for joining or connecting with a mating connector (not shown). The mating connector may, for example, be located on a component, a circuit board or on the back of an electronic box, such as a printer, PC, and the like. Screw locks 132 and 134 are rotatably mounted on opposite sides of the housing 102 proximate the first and second sidewalls 126 and 128, respectively. Screws 136 and 138 extend from the screw locks 132 and 134 to secure the housing 102 to the component.

Figure 6:
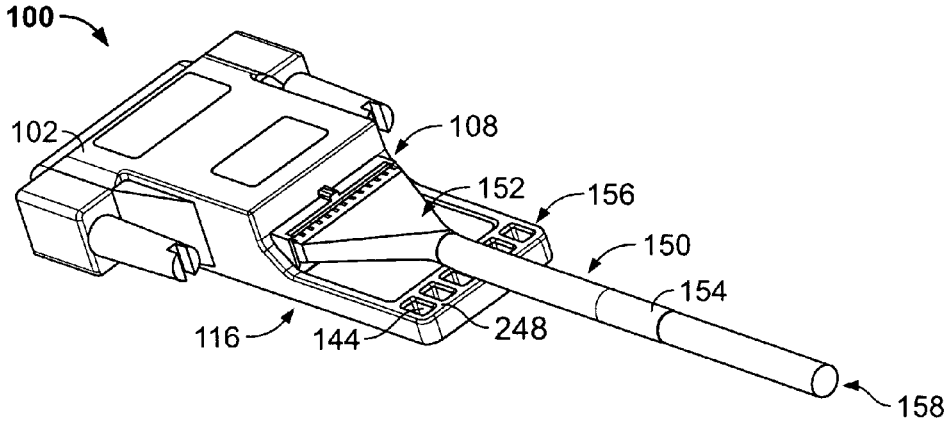
FIG. 6 illustrates the adaptor interconnected with the cable assembly in accordance with an embodiment of the present invention.
Figure 9:
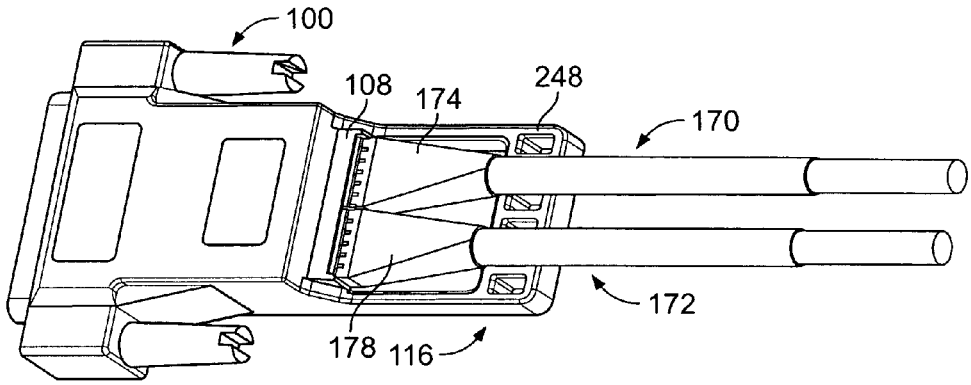
FIG. 9 illustrates the adaptor interconnected with the first and second cable assemblies in accordance with an embodiment of the present invention.
Figure 12:
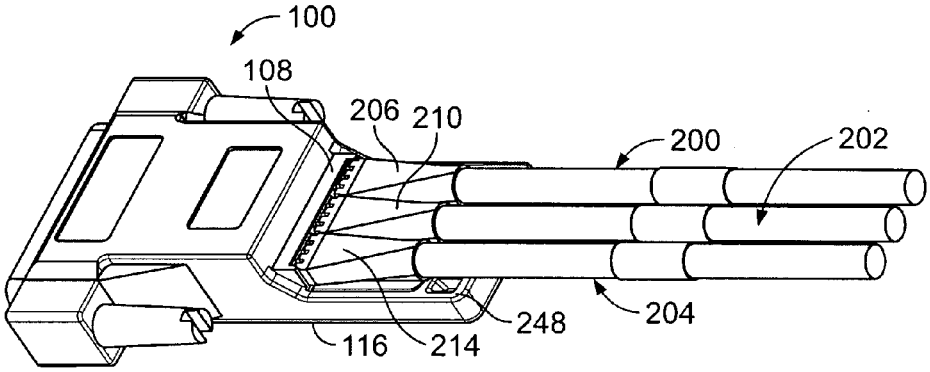
FIG. 12 illustrates the adaptor interconnected with the first, second and third cable assemblies in accordance with an embodiment of the present invention.

The housing 102 has a rear end 142 having a second mating face 108 with a set of contacts 110 which can be joined with a cable assembly (FIGS. 6, 9 and 12). The second mating face 108 has a width $W_1$. The rear end 142 is opposed to the front end 140, but alternatively may be oriented at an acute angle or perpendicular to one another.

A strain relief 116 is formed integral with the housing 102. The strain relief 116 extends from the housing 102 beyond the second mating face 108 and has a top surface 248, and side walls 274 and 286. The second mating face 108 is aligned along a first plane, while the strain relief 116 is aligned along a second plane substantially perpendicular to the first plane. Optionally, an angle created between the first and second planes may be 90 degrees, approximately 90 degrees, or greater or less than 90 degrees. The strain relief 116 has first and second support arms 118 and 120 extending from the housing 102 integral with the first and second sidewalls 126 and 128, respectively. The strain relief 116 includes a cross-bar 130 spaced distance $D_1$ from the second mating face 108 to form an opening 117 therebetween. The strain relief 116 spans the width $W_1$ of the second mating face 108. The cross-bar 130 forms a platform on which one or more cable assemblies may rest when interconnected to the second mating face 108. Optionally, the strain relief 116 may be formed of a solid piece of material without the opening 117, such as a flat plate.

Apertures 144 are formed in and extend through the cross-bar 130. The apertures 144 may receive one or more securing members (not shown) to securely hold one or more cable assemblies in place when the cable assemblies are interconnected with the second mating face 108. Optionally, the cross-bar 130 may be formed of a solid piece of material without apertures 144.

Figure 3:
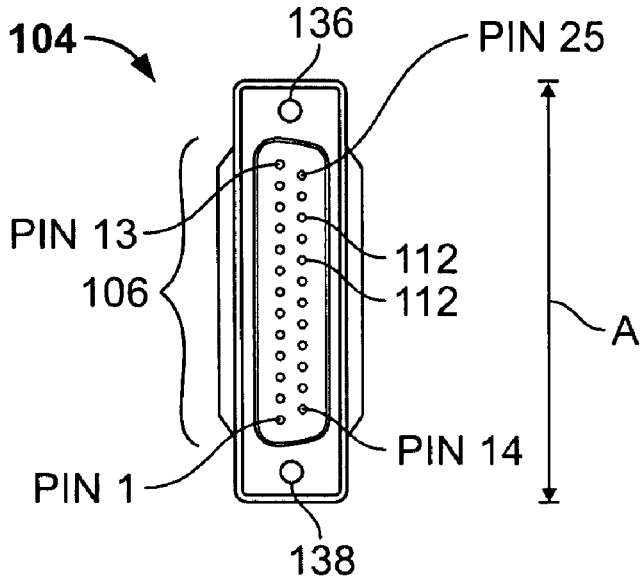
FIG. 3 illustrates an exemplary mating face.

FIG. 3 illustrates a front plan view of the first mating face 104. Contact pins 112 within the set of contacts 106 form a first contact pattern. For example, the set of contacts 106 within the first mating face 104 may have 25 contact pins 112 with designated pin numbers 1–25. The pins 112 are arranged in two parallel planes in the direction of arrow A with the pins 112 in the first plane offset in relation to the pins 112 in the second plane. For example, the first mating face 104 may be a DB25 type of mating connector. Alternatively, the set of contacts 106 may form a pattern having 9 pins 112 that form a DB9 type of mating connector, or form a pattern having 49 pins 112. It should be understood that other patterns may be formed and other numbers of pins 112 may be used within the set of contacts 106.

Figure 4:
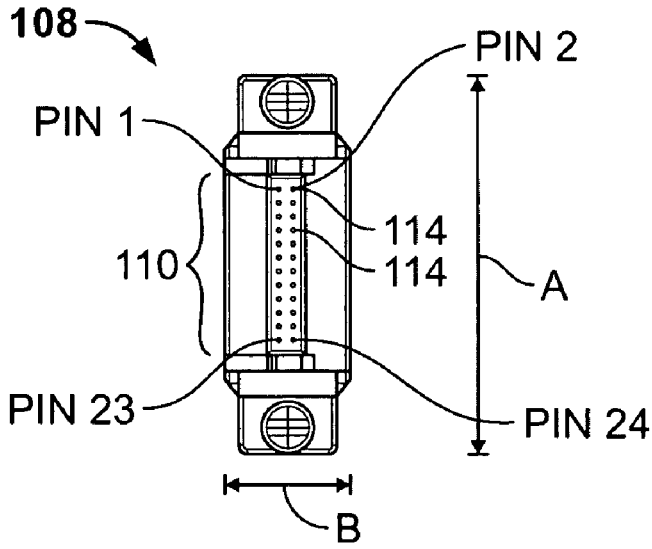
FIG. 4 illustrates another exemplary mating face.

FIG. 4 illustrates a front plan view of the second mating face 108. The set of contacts 110 forms a different contact pattern than the set of contacts 106. The set of contacts 110 has 24 pins 114 which are held within the second mating face 108 in two parallel planes in the direction of arrow A and twelve parallel planes in the direction of arrow B. Each of the 24 pins 114 is in communication with one pin 112, therefore, one pin 112 within the set of contacts 106 may not be used. The second mating face 108 may form a 2 mm multi-pin plug connector, for example. The first and second mating faces 104 and 108 are exemplary embodiments of pin arrangements. It should be understood that other arrangements may be used by the adapter 100 to interconnect one type of connector to a different type of connector.

Figure 5:
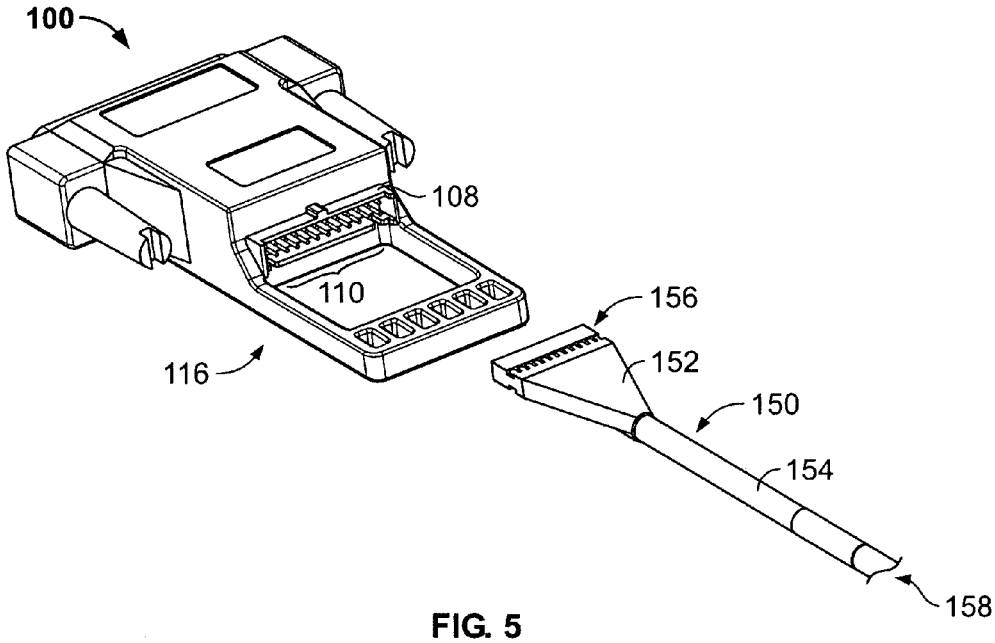
FIG. 5 illustrates the adaptor of FIG. 1 and a cable assembly to be joined thereto in accordance with an embodiment of the present invention.

FIG. 5 illustrates the adaptor 100 and a cable assembly 150 to be joined thereto in accordance with an embodiment of the present invention. The cable assembly 150 has a connector 152 at a first end 156 of a cable 154 which is to be joined with the second mating face 108 of the adaptor 100. The cable assembly 150 has the same number of pins and the same contact pattern as the second mating face 108. A second end 158 of the cable 154 may be attached to a different connector (not shown) or hard wired to a component.

FIG. 6 illustrates the adaptor 100 interconnected with the cable assembly 150 in accordance with an embodiment of the present invention. The connector 152 is received by the second mating face 108. The cable assembly 150 rests against the top surface 248 of the strain relief 116 of the adaptor 100.

Figure 7:
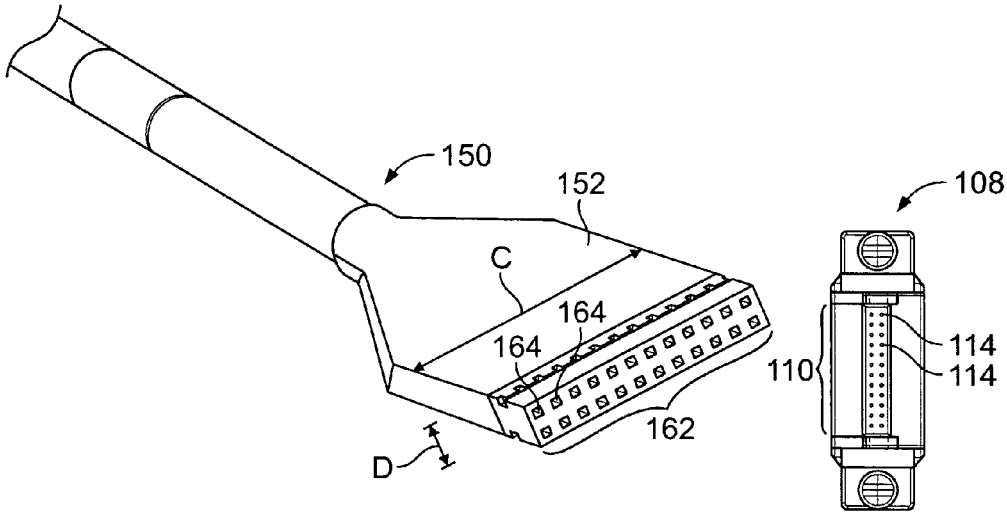
FIG. 7 illustrates a set of contacts within the connector of the cable assembly of FIG. 5 and the second mating face in accordance with an embodiment of the present invention.

FIG. 7 illustrates a set of contacts 162 within the connector 152 of the cable assembly 150 of FIG. 5 and the second mating face 108 of FIG. 4 in accordance with an embodiment of the present invention. The set of contacts 162 has 24 holes 164, each of which receives one pin 114 of the second mating face 108. The set of contacts 162 are arranged to occupy two parallel planes along the direction of arrow C and twelve parallel planes along the direction of arrow D. The connector 152 is inserted into the second mating face 108 and accepts the pins 114 with the holes 164. The sets of contacts 110 and 162 may be arranged differently than illustrated, allowing alternate configurations.

Figure 8:
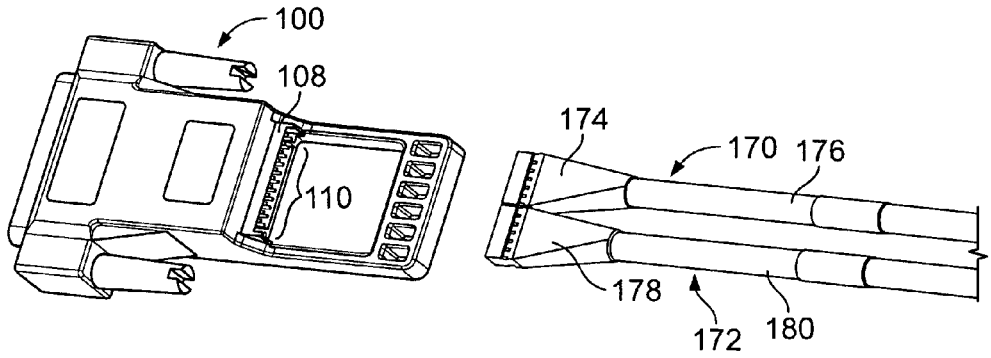
FIG. 8 illustrates the adaptor of FIG. 1 and first and second cable assemblies to be joined thereto in accordance with an embodiment of the present invention.

FIG. 8 illustrates the adaptor 100 and first and second cable assemblies 170 and 172 to be joined thereto in accordance with an embodiment of the present invention. The first cable assembly 170 has a first connector 174 and a cable 176, and the second cable assembly 172 has a second connector 178 and a cable 180. The first and second cable assemblies 170 and 172 have the same number of pins and the same contact pattern, which matches one-half of the contact pattern of the set of contacts 110 within the second mating face 108.

FIG. 9 illustrates the adaptor 100 interconnected with the first and second cable assemblies 170 and 172 in accordance with an embodiment of the present invention. The first and second connectors 174 and 178 occupy a parallel plane and are received side-by-side by the second mating face 108. When connected to the second mating face 108, the first and second cable assemblies 170 and 172 rest against the top surface 248 of the strain relief 116 of the adaptor 100. Alternatively, the first and second connectors 174 and 178 may be formed such that the first and second cable assemblies 170 and 172 are connected to the second mating face 108 one on top of the other. Therefore, alternative assemblies and arrangements may be used.

Figure 10:
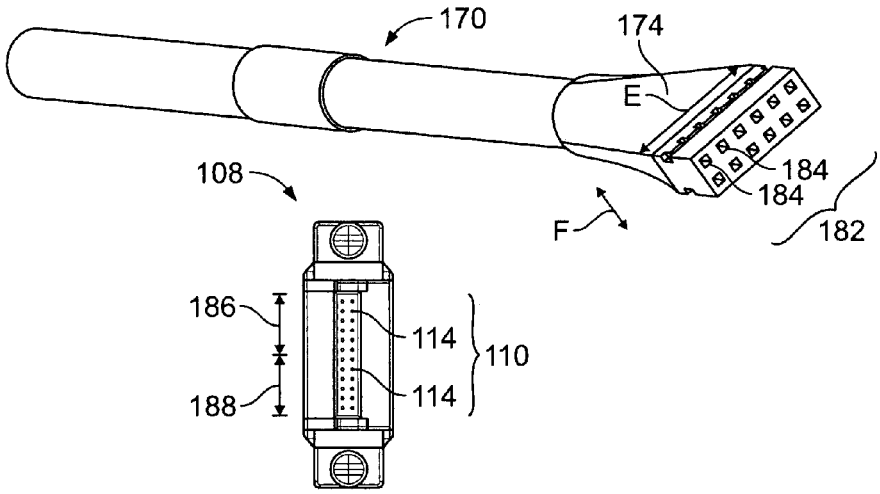
FIG. 10 illustrates a set of contacts within the first connector of the first cable assembly and the second mating face in accordance with an embodiment of the present invention.

FIG. 10 illustrates a set of contacts 182 within the first connector 174 of the first cable assembly 170 of FIG. 8 and the second mating face 108 of FIG. 4 in accordance with an embodiment of the present invention. The set of contacts 182 has twelve holes 184, each of which receives one pin 114 held within the second mating face 108. The set of contacts 182 are arranged to occupy two parallel planes along the direction of arrow E and six parallel planes along the direction of arrow F. The first connector 174 is inserted into the second mating face 108 and accepts the pins 114 of a first half 186 of the set of contacts 110, and the second connector 178 is inserted into the second mating face 108 and accepts the pins 114 of a second half 188 of the set of contacts 110. It should be understood that one of the first and second cable assemblies 170 and 172 may be used without the other, and that a single cable assembly may use a subset of the set of contacts 110 which is different from the first and second halves 186 and 188. Also, the sets of contacts 110 and 182 may be arranged in a different contact pattern to allow for alternate configurations.

Figure 11:
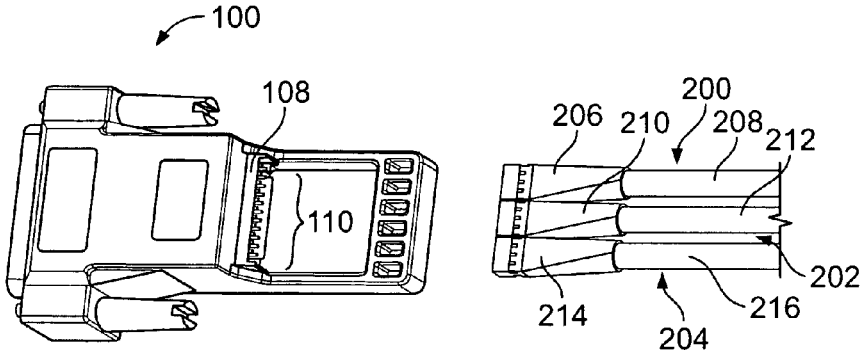
FIG. 11 illustrates the adaptor of FIG. 1 and first, second and third cable assemblies to be joined thereto in accordance with an embodiment of the present invention.

FIG. 11 illustrates the adaptor 100 and first, second and third cable assemblies 200, 202 and 204 to be joined thereto in accordance with an embodiment of the present invention. The first cable assembly 200 has a first connector 206 and a cable 208, the second cable assembly 202 has a second connector 210 and a cable 212, and the third cable assembly 204 has a third connector 214 and a cable 216. The first, second and third cable assemblies 200, 202 and 204 have the same number of pins and the same contact pattern, which matches one third of the contact pattern of the second mating face 108.

FIG. 12 illustrates the adaptor 100 interconnected with the first, second and third cable assemblies 200, 202 and 204 in accordance with an embodiment of the present invention. The first, second and third connectors 206, 210 and 214 are received side-by-side by the second mating face 108. The first, second and third connectors 206, 210 and 214 occupy a parallel plane. The first, second and third cable assemblies 200, 202 and 204 rest against the top surface 248 of the strain relief 116 of the adaptor 100.

Figure 13:
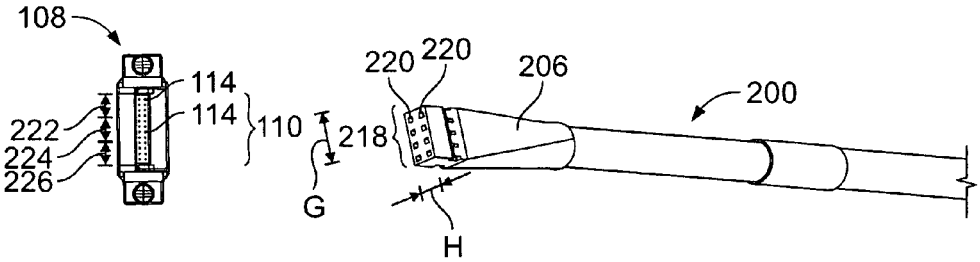
FIG. 13 illustrates a set of contacts within the first connector of the first cable assembly and the second mating face in accordance with an embodiment of the present invention.

FIG. 13 illustrates a set of contacts 218 within the first connector 206 of the first cable assembly 200 of FIG. 11 and the second mating face 108 of FIG. 4 in accordance with an embodiment of the present invention. The set of contacts 218 has eight holes 220, each of which receives one pin 114 of the second mating face 108. The set of contacts 218 are arranged to occupy two parallel planes along the direction of arrow G and four parallel planes along the direction of arrow H. Each of the first, second and third connectors 206, 210 and 214 are inserted into the second mating face 108 and accept a third of the pins 114 of the set of contacts 110. For example, the first, second and third connectors 206, 210 and 214 are interconnected with first, second and third sections 222, 224 and 226, respectively, of the set of contacts 110.

It should be understood that one or two of the cable assemblies 200, 202 and 204 may be used without the others. Alternatively, connectors 174 and 206 of cable assemblies 170 and 200, respectively, may be received side-by-side by the second mating face 108. Optionally, other combinations of connectors having different numbers of contacts and/or different configurations may be used.

Figure 14:
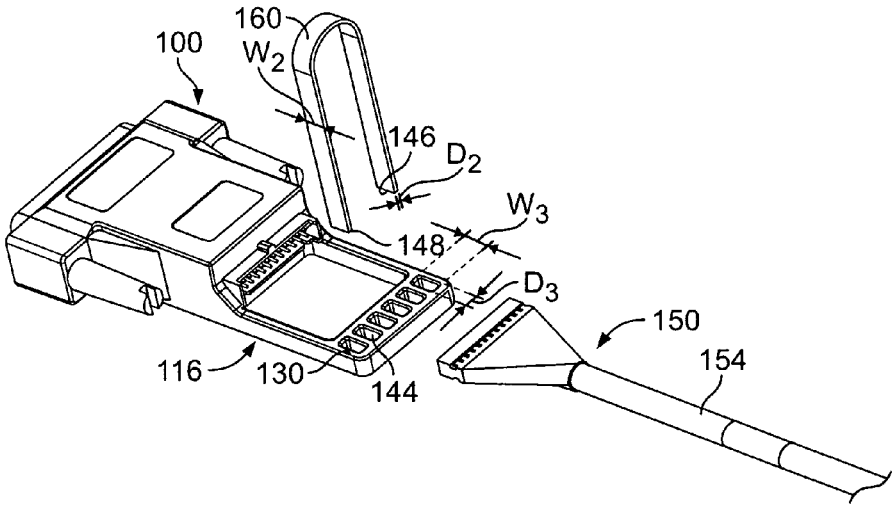
FIG. 14 illustrates the adapter and cable assembly of FIG. 6 and a cable tie for securing the cable assembly to the adaptor in accordance with an embodiment of the present invention.

FIG. 14 illustrates a cable tie 160 for securing the cable assembly 150 to the adaptor 100 in accordance with an embodiment of the present invention. The cable tie 160 has a width $W_2$ and a depth $D_2$ which are less than or substantially equal to width $W_3$ and depth $D_3$, respectively, of the apertures 144. The cable tie 160 has an overall length from end 146 to end 148 which may vary depending upon the size of the cable 154 and thickness of the cross-bar 130. The cable tie 160 may be formed of wire, which retains its shape when twisted. Alternatively, the cable tie 160 may be formed of other material known to those skilled in the art, such as nylon or Velcro, for example.

Figure 15:
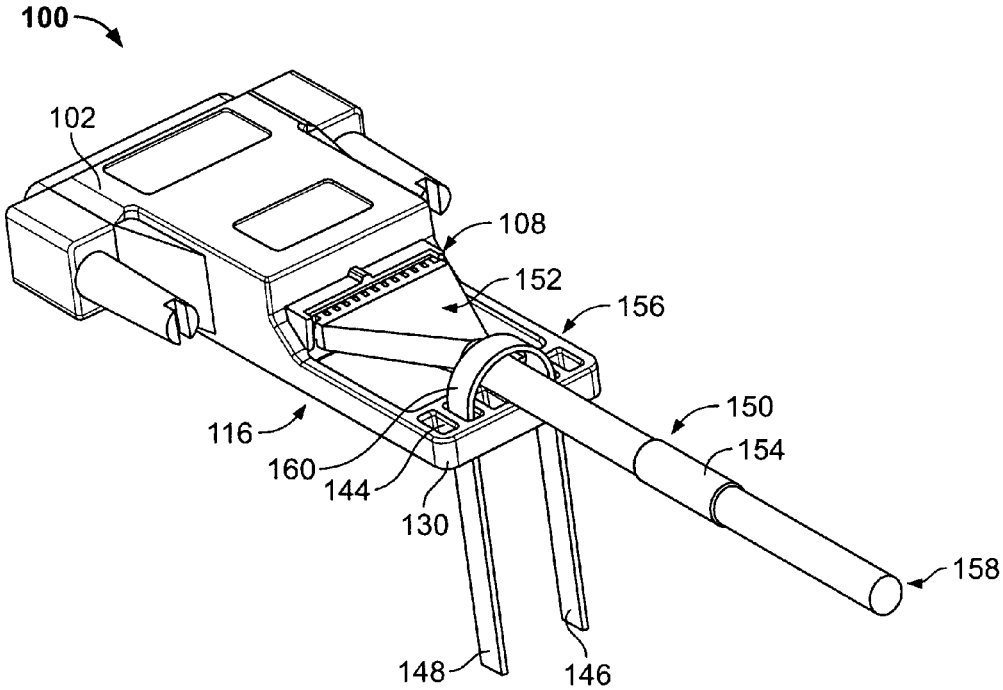
FIG. 15 illustrates the adaptor joined to the cable assembly with the cable tie inserted through two of the holes in the strain relief in accordance with an embodiment of the present invention.

FIG. 15 illustrates the adaptor 100 joined to the cable assembly 150 with the cable tie 160 inserted through two of the apertures 144 in the cross-bar 130 of the strain relief 116 in accordance with an embodiment of the present invention. Although the cable assembly 150 is illustrated, one of the cable assemblies 170 and 172 or 200, 202 and 204 may be used. The connector 152 is joined with the second mating face 108 of the adaptor 100 as discussed previously. The ends 146 and 148 of the cable tie 160 are inserted through two of the apertures 144 on either side of the cable 154. Depending upon the material and construction of the cable tie 160, the ends 146 and 148 may be twisted together, fastened to one another, snapped, soldered, glued, held with Velcro, or otherwise secured to hold the cable assembly 150 to the strain relief 116. If more than one cable assembly is used, such as in FIGS. 9 and 12, one or more cable ties 160 may be used to secure the cable assemblies to the strain relief 116.

Figure 16:
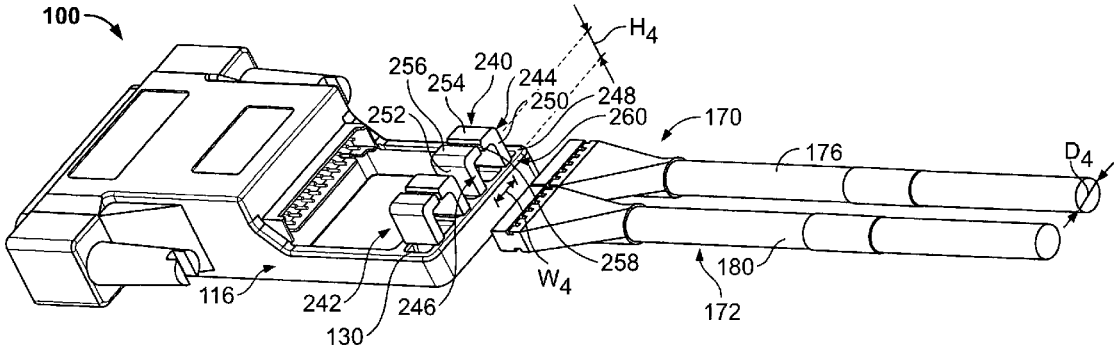
FIG. 16 illustrates the adaptor with a securing member and the first and second cable assemblies in accordance with an embodiment of the present invention.

FIG. 16 illustrates the adaptor 100 with a securing member and the first and second cable assemblies 170 and 172 in accordance with an embodiment of the present invention. The securing member includes first and second latches 240 and 242 for securing the first and second cable assemblies 170 and 172 to the strain relief 116. In the exemplary embodiment, the first and second latches 240 and 242 are substantially the same, as the first and second cables 176 and 180 are substantially the same size in diameter. It should be understood that the first and second latches 240 and 242 may be different. By way of example, the first latch 240 will be discussed below.

The first latch 240 is formed of first and second portions 244 and 246, which are attached to the top surface 248 of the cross-bar 130 of the strain relief 116. First and second portions 244 and 246 extend outwardly from the top surface 248, forming approximately a 90 degree angle with the top surface 248. The first and second portions 244 and 246 are bent and formed, molded, or otherwise manufactured to form wall portions 250 and 252 and top portions 254 and 256. The first latch 240 may be formed of a flexible material or any material known to one skilled in the art. A gap 258 may be present between inner faces of the top portions 254 and 256. The first and second portions 244 and 246 form a conduit 260 having a height $H_4$ and a width $W_4$. The height $H_4$ and width $W_4$ may be approximately slightly larger than diameter $D_4$ of the cable 176. The size and quantity of the latches may vary, as well as the position of the latches with respect to the strain relief 116, to allow for different equipment configurations.

Figure 17:
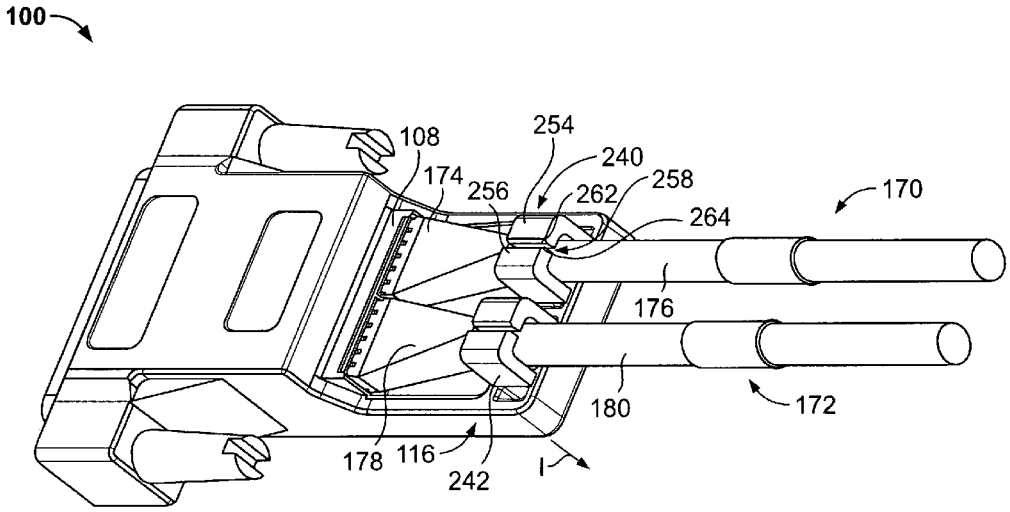
FIG. 17 illustrates the first and second latches securing the first and second cable assemblies to the strain relief of the adaptor in accordance with an embodiment of the present invention.

FIG. 17 illustrates the first and second latches 240 and 242 securing the first and second cable assemblies 170 and 172 to the strain relief 116 of the adaptor 100 in accordance with an embodiment of the present invention. The first and second cable assemblies 170 and 172 can be secured by the first and second latches 240 and 242 either prior to or after joining the first and second connectors 174 and 178 with the second mating face 108 as discussed previously in FIG. 9. The first cable 176 is pushed into the gap 258 between the top portions 254 and 256 in the direction of arrow I. An angle 262 and 264 cut into the top portions 254 and 256 leading into the gap 258 may facilitate the insertion of the cable 176 into the gap 258. The first and second top portions 254 and 256 flex outwardly, then, when the cable 176 is within the conduit 260, the first and second top portions 254 and 256 return to their original position. Therefore, the first and second latches 240 and 242 securely hold the first and second cable assemblies 170 and 172 as the cables 176 and 180 rest on the strain relief 116.

Figure 18:
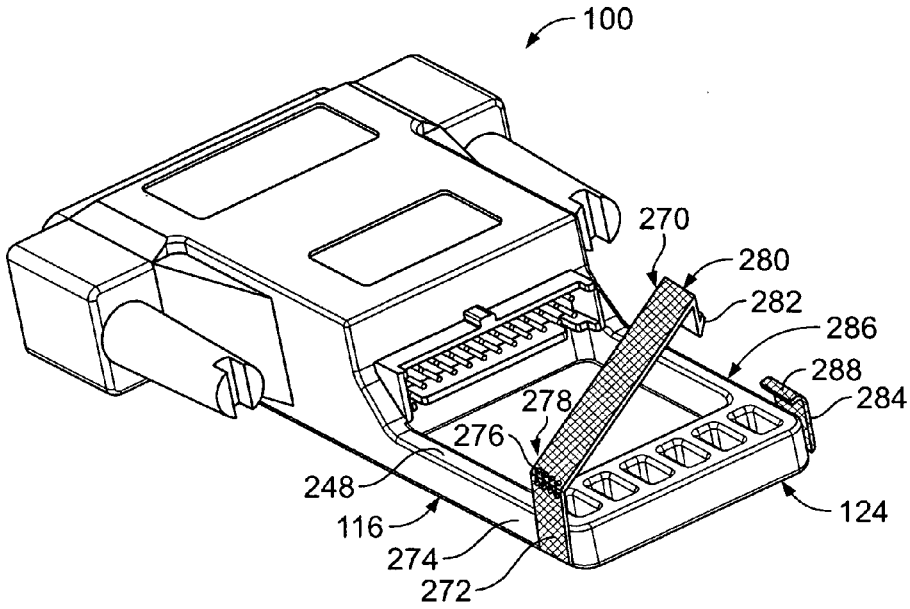
FIG. 18 illustrates an adapter with a locking arm used to secure one or more cable assemblies to the adaptor in accordance with an embodiment of the present invention.

FIG. 18 illustrates a locking arm 270 used to secure one or more cable assemblies to the adaptor 100 in accordance with an embodiment of the present invention. First and second side portions 272 and 284 may be formed integral with the strain relief 116 or adhered to the side wall 274 or 286, respectively, of the strain relief 116. The first side portion 272 is connected to a hinge mechanism 276 or other rotatable device. A first end 278 of the locking arm 270 is connected to the hinge mechanism 276, allowing rotatable motion between the locking arm 270 and the strain relief 116. Alternatively, the hinge mechanism 276 may be formed integral with the strain relief 116, whereby the first side portion 272 would not be needed. The second side portion 284 is formed with a lip 288 extending approximately horizontally with the top surface 248 of the strain relief 116. A second end 280 of the locking arm 270 is formed with a protrusion 282 which is securely latched under the lip 288 of the second side portion 284. Alternatively, the protrusion 282 may be formed as a hook to extend below the strain relief 116, whereby the locking arm 270 forms a clip when the protrusion 282 rests against the bottom surface 124. Thus, the second side portion 284 would not be needed. Optionally, the locking arm 270 may be spring loaded, providing additional ease when cable assemblies need to be removed from the adaptor 100.

When in the latched position, the locking arm 270 allows sufficient space between the locking arm 270 and the strain relief 116 for the cable assemblies to rest on the strain relief 116 without damaging the cable or allowing excessive movement of the cable. Therefore, the locking arm 270 securely holds the cable assembly or assemblies to the strain relief 116. The locking arm 270 may be formed of any suitable material known to one skilled in the art.

Figure 19:
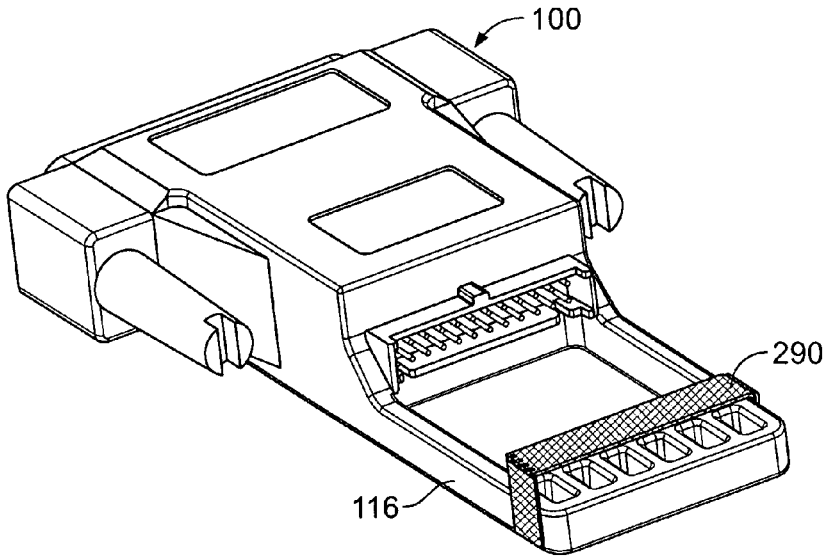
FIG. 19 illustrates a locking band used to secure one or more cable assemblies to the adaptor in accordance with an embodiment of the present invention.

FIG. 19 illustrates a locking band 290 used to secure one or more cable assemblies to the adaptor 100 in accordance with an embodiment of the present invention. The locking band 290 may be formed of a single piece of material, such as rubber, plastic, cloth, or other material which may be attached to the strain relief 116 and/or itself with an adhesive. Alternatively, the locking band 290 may exert tension on the cable assemblies to secure the cable assemblies to the strain relief 116.

Figure 20:
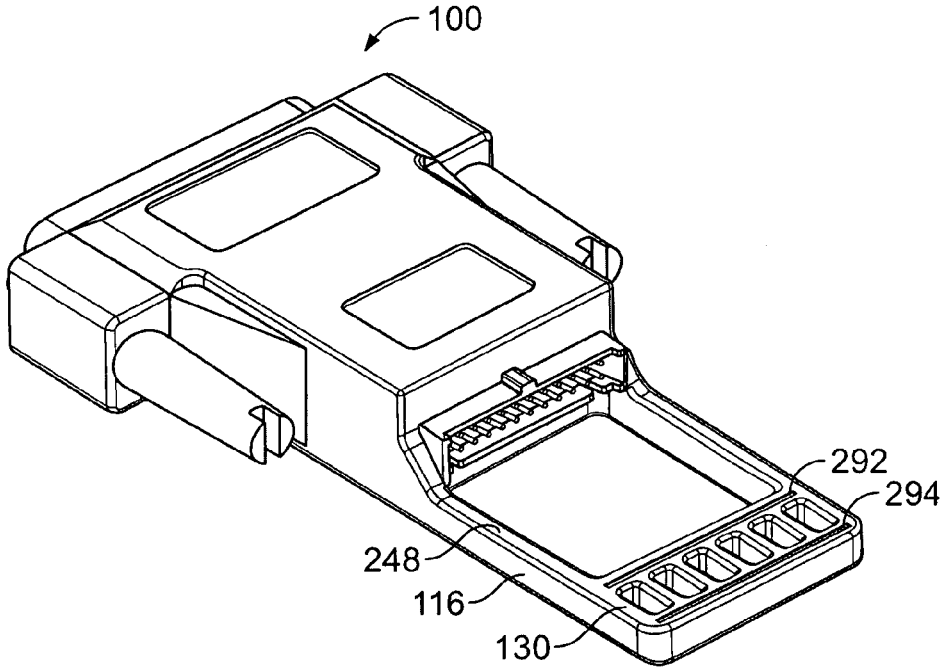
FIG. 20 illustrates an adhesive substance which may be provided on the top surface of the strain relief in accordance with an embodiment of the present invention.

FIG. 20 illustrates an adhesive substance 292 and 294 which may be provided on the top surface 248 of the strain relief 116 in accordance with an embodiment of the present invention. The adhesive substance 292 and 294 may be applied in strips as illustrated, or may be applied over all or a portion of the top surface 248 of the cross-bar 130. The adhesive substance 292 and 294 may adhere to the cable assemblies when the cable assemblies and the strain relief 116 are pressed together. Alternatively, a protective cover (not shown) may be provided over the adhesive substance 292 and 294 and then removed when the cable assemblies and strain relief 116 are to be secured together.

While the invention has been described in terms of various specific embodiments, those skilled in the art will recognize that the invention can be practiced with modification within the spirit and scope of the claims.

What is claimed is:

1. An electrical connector adaptor, comprising:

first and second signal contact sets;

a housing having a first mating face configured to mate with a mating connector, the housing having a second mating face configured to mate with a cable assembly connector, the first and second mating faces retaining the first and second signal contact sets in different first and second patterns, respectively, to provide an interface between different signal contact configurations at the cable assembly connector and the mating connector; and a strain relief extending from the housing, the strain relief projecting beyond the second mating face and positioned such that the cable assembly connector is held by the strain relief external to the housing when the cable assembly connector is mated to the second mating face.

2. The adaptor of claim 1, wherein the second mating face is configured to be joined to at least two cable assembly connectors mounted side-by-side to the second mating face, the adaptor further comprising a securing member being configured to secure the at least two cable assembly connectors to the strain relief.

3. The adaptor of claim 1, wherein the strain relief includes a cross-bar spaced from the second mating face and spanning a width of the second mating face.

4. The adaptor of claim 1, wherein the strain relief includes a pair of support arms formed integral with, and extending from, the housing along opposite sides of the second mating face.

5. The adaptor of claim 1, wherein the strain relief forms a platform located immediately adjacent an area in which the cable assembly connector is located when joined to the second mating face.

6. The adaptor of claim 1, wherein the second mating face defines a mating plane and the strain relief projects outward perpendicular to the mating plane.

7. The adaptor of claim 1, further comprising a securing member configured to secure one of a cable and the cable assembly connector to the strain relief, wherein the securing member includes at least one of a wire tie, a cable tie, a locking band, a latch, adhesive and a clip.

8. The adaptor of claim 1, further comprising a securing member configured to secure one of a cable and the cable assembly connector to the strain relief, wherein the securing member includes a locking arm formed integral with the strain relief, the locking arm having one end rotatably joined to the strain relief and a second end with a latch to be secured to the strain relief.

9. The adaptor of claim 1, wherein the strain relief forms a flat plate.

10. The adaptor of claim 1, wherein the first pattern constitutes one of a DB25, DB9, and 48 pin pattern.

11. An adaptor and cable assembly, comprising:

a cable assembly with a cable and a connectors provided on an end thereof; and an adaptor, comprising:

first and second signal contact sets;

a housing having a first mating face configured to mate with a mating connector, the housing having a second mating face configured to mate with the connector of the cable assembly, the first and second mating faces retaining the first and second signal contact sets in different first and second patterns, respectively, to provide an interface between different signal contact configurations at the connector of the cable assembly and the mating connector;

a strain relief extending from the housing, the strain relief projecting beyond the second mating face, the connector of the cable assembly is held by the strain relief external to the housing when joined to the second mating face; and a securing member securing one of the cable and connector of the cable assembly to the strain relief.

12. The assembly of claim 11, further comprising at least two connectors on cable assemblies mounted side-by-side to the second mating face, the securing member securing the at least two connectors on cable assemblies to the strain relief.

13. The assembly of claim 11, wherein the strain relief includes a cross-bar spaced from the second mating face and spanning a width of the second mating face.

14. The assembly of claim 11, wherein the strain relief includes a pair of support arms formed integral with, and extending from, the housing along opposite sides of the second mating face.

15. The assembly of claim 11, wherein the strain relief forms a platform located immediately adjacent an area in which the cable assembly is located when joined to the second mating face.

16. The assembly of claim 11, wherein the second mating face defines a mating plane and the strain relief projects outward perpendicular to the mating plane.

17. The assembly of claim 11, further comprising a pair of screw locks held by the housing and located proximate opposite sides of the housing, the screw locks configured to secure the housing to a component.

18. The assembly of claim 11, wherein the securing member includes at least one of a wire tie, a cable tie, a locking band, a latch, adhesive and a clip.

19. The assembly of claim 11, wherein the securing member includes a locking arm formed integral with the strain relief, the locking arm having one end rotatably joined to the strain relief and a second end with a latch to be secured to the strain relief.

20. The assembly of claim 11, wherein the second mating face is configured to receive at least one 2 mm connector.

* * * * *